United States Patent [19]

Salto

[11] 3,957,149

[45] May 18, 1976

[54] SELECTOR SYSTEM FOR A TYPE-BEARING ELEMENT OF AN OFFICE MACHINE

[75] Inventor: Rinaldo Salto, Ivrea, Italy

[73] Assignee: Ing. C. Oliverti & Co. S.p.A., Ivrea, Italy

[22] Filed: Dec. 26, 1974

[21] Appl. No.: 536,406

[30] Foreign Application Priority Data

Dec. 28, 1973 Italy ..... 70875/73

[52] U.S. Cl. ..... 197/16; 197/18

[51] Int. Cl.² ..... B41J 23/02

[58] Field of Search ..... 197/16, 18, 52

[56] References Cited

UNITED STATES PATENTS

| | | | |
|---|---|---|---|
| 892,891 | 7/1908 | Richards | 197/18 |
| 2,847,105 | 8/1958 | Carroll | 197/16 |
| 2,926,768 | 3/1960 | Becker et al. | 197/52 |
| 3,770,095 | 11/1973 | Guerrini et al. | 197/18 |
| 3,780,845 | 12/1973 | Boyden | 197/18 |

*Primary Examiner*—Wm. H. Grieb

[57] ABSTRACT

A selector system for a type-bearing element of a typewriter, accounting machine or other office machines, wherein a positioning member for the type-bearing element is positioned positively by a series of cam followers movable by a corresponding series of cyclically actuated cams and controlled by selectively settable stop elements. The type-bearing element comprise a shell on which the types are distributed in rows and columns. The shell is rotatable on a support sleeve provided with two side walls external to the shell. The types are distributed in two groups selectable by a transport mechanism connected to the type-bearing element through differential gears controlled by a bistable spring and two stop elements.

23 Claims, 14 Drawing Figures

SELECTOR SYSTEM FOR A TYPE-BEARING ELEMENT OF AN OFFICE MACHINE

BACKGROUND OF THE INVENTION

A teleprinter selector system is known wherein the cam followers comprise five levers pivoted on a fixed shaft and connected to a movement adding mechanism for positioning the type-bearing element. A series of springs cause the five cam follower levers to co-operate with five corresponding cams. A series of stop pins which are set on reception of a telegraphic code arrest a number of the levers in combinations corresponding to the code in the rest position corresponding to the highest profile of the cams, while other levers are free to follow the cams. When the cams present their lowest profile to the corresponding cam followers, the type-bearing element is positioned starting from a rest position in dependence upon the combination of levers which are left free. This system, employing a negative positioning of the type-bearing element, is not, however, adapted to permit high printing speeds. Moreover, it uses a high number of parts which make the system itself more complex and costly.

SUMMARY OF THE INVENTION

An object of the present invention is to provide a selector system for a type-bearing element employing cams and cam followers which is simple and of relatively low cost and by which the positioning of the type-bearing element is obtained positively.

Another object of the present invention is to provide a selector system for a type-bearing element employing differential gears for selecting a group of types which is simple, and of relatively low cost, and by which the positioning of the group of types is obtained exactly.

Another object of the present invention is to provide a simple and relatively low cost type-bearing element.

A further object of the present invention is to obtain a positive positioning of type-bearing element and a returning at rest thereof avoiding any rebound.

According to the present invention there is provided a selector system for a type-bearing element of a typewriter, teleprinter, accounting machine or other office machine, wherein a positioning member for the type-bearing element is positioned by a series of cam followers movable by a corresponding series of cyclically actuated cams and controlled by selectively settable stop elements, comprising a series of selector members each of which carries pivotally a corresponding cam follower and is arrestable selectively by a set stop element to permit the cam follower pivoted on the arrested selector member to position the positioning member positively through the agency of the corresponding cam.

DESCRIPTION OF THE DRAWINGS

The invention will be described in more detail, by way of example, with reference to the accompanying drawings, wherein.

GENERAL DESCRIPTION

Figure 1:
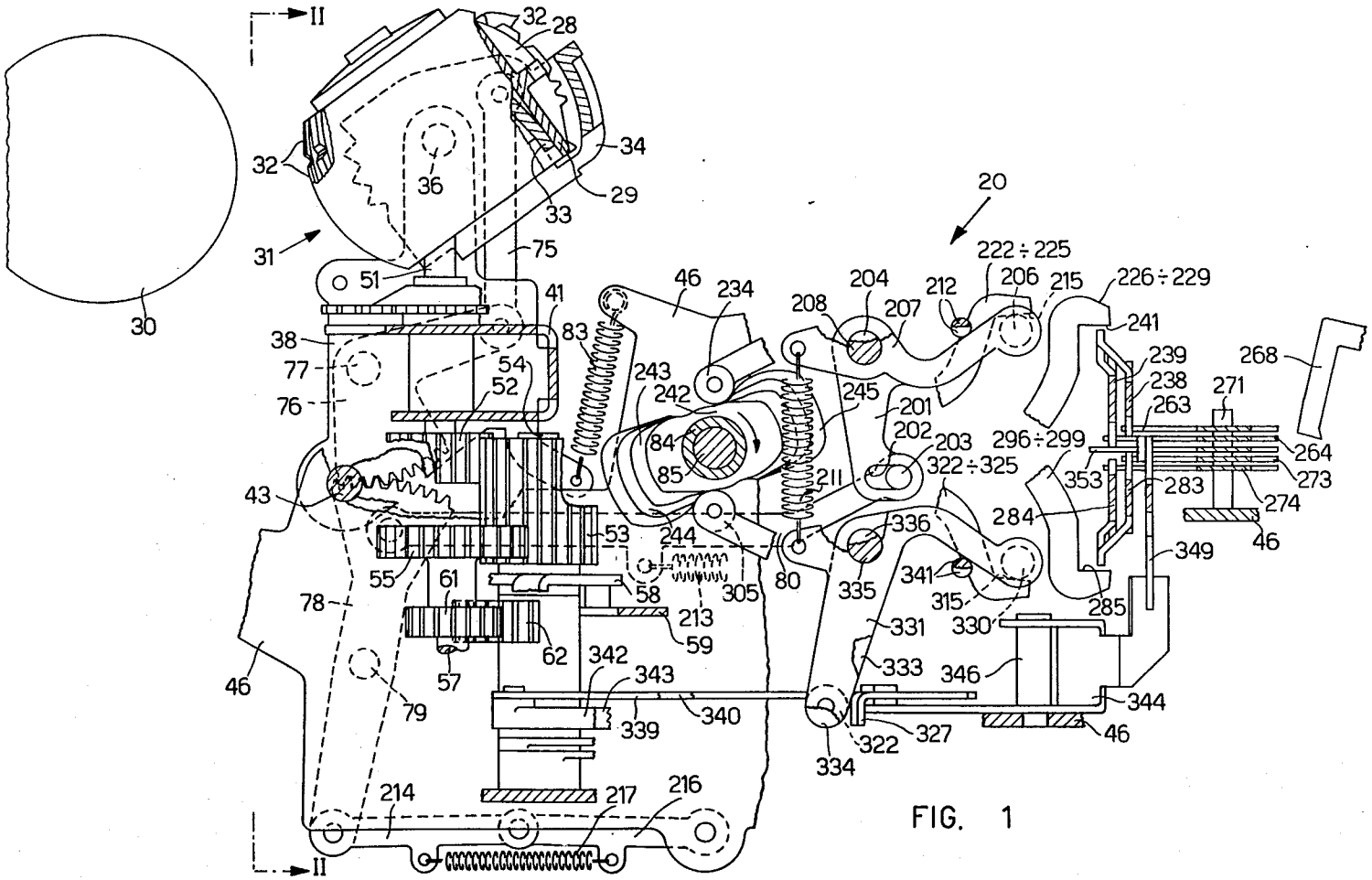
FIG. 1 is a partial side view of a typewriter incorporating a selector system embodying the invention.

Referring to FIG. 1, the selector system, indicated generally here by the reference 20, is applied by way of example to a typewriter having a platen or cylinder 30 movable transversely with respect to the frame 46 of the machine in a manner known per se.

The typewriter comprises a type-bearing element constituted by a head 31 with a substantially vertical axis and having types or characters 32 disposed in rows and columns and grouped in "lower-case" and "upper-case" characters. The head 31 is mounted in front of the platen 30 on a support 38 movable for the striking action.

Figure 7:
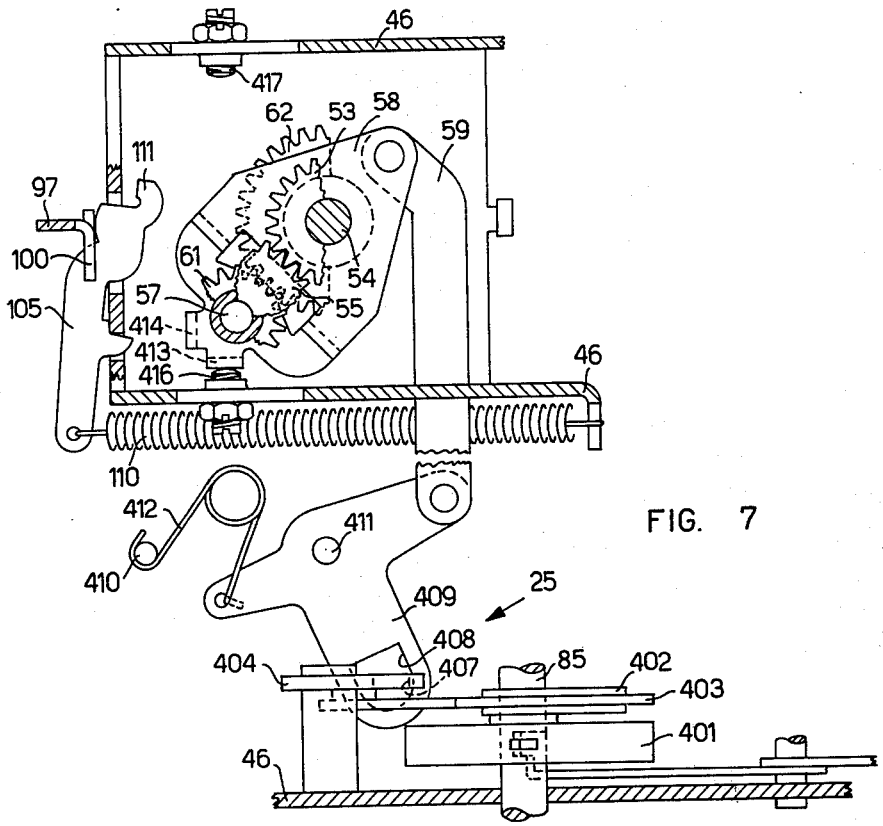
FIG. 7 is a partial plan view showing other details of the selector system.

For selection of the character to be typed, the head 31 can rotate and tilt with respect to the support 38. A shift mechanism indicated by the reference 25 (FIG. 7) and adapted to be activated in known manner independently of the selector system or mechanism 20 provides for rotating the head 31 through 180° to dispose the groups of "lower-case" or "upper-case" characters in front of the platen 30.

For tilting and rotating the head 31 (FIG. 1), the selector system 20 is provided with an upper portion for selection of the rows and a lower portion for selection of the columns.

The selector system or mechanism 20 is adapted to be activated by a group of selector bars 263, 264, 353, 273 and 274 which can be set on the keyboard in combinations corresponding to the key depressed.

TYPING HEAD

The type-bearing head indicated generally by the reference 31 comprises a substantially cylindrical shell 29 from which there project eighteen ribs or columns 28 of circular profile. Corresponding types or characters 32 aligned in five rows are distributed on the ribs 28 and are thus disposed on a substantially spherical surface. The nine columns 28 normally disposed in front of the platen 30 are centred with respect to the platen 30 and bear a group of "lower-case" characters, while the nine opposite columns bear a group of "upper-case" characters. The characters 32 are moreover arranged so that those of equal typing area are distributed on the same columns 28.

Figure 5:
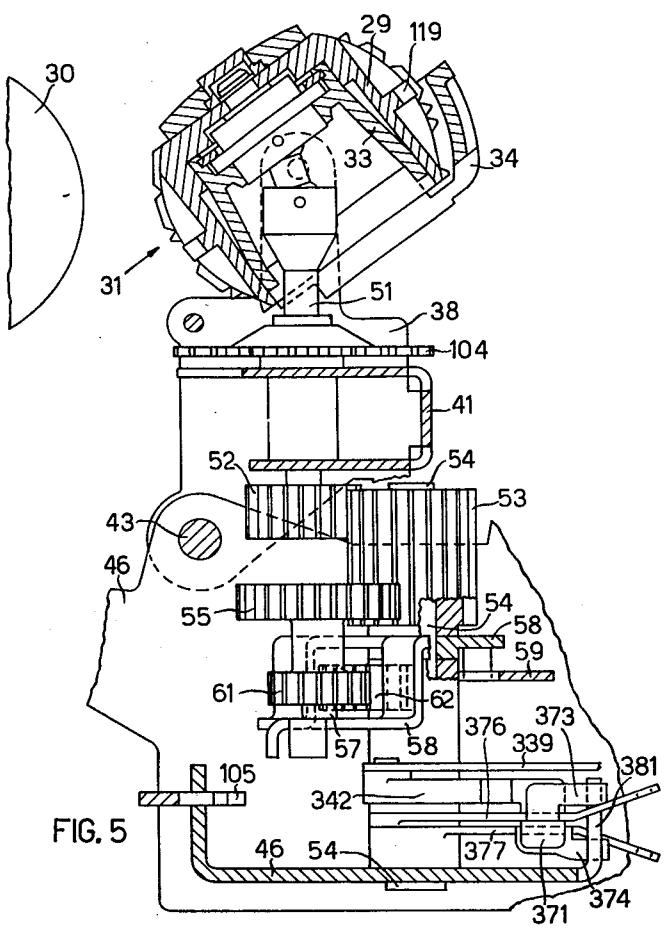
FIG. 5 is a partial side sectional view of FIG. 1.

The head 31, with its shell 29, is rotatable on a hub 33 (FIG. 5) projecting at the top from a seat 34. The seat has the form of a spherical sector, is open at the top and in the portion disposed in front of the platen 30 and thus protects the head 31 over about one quarter of its area in the front and lower portions thereof. The seat 34 is pivoted between two arms 38 and 39 of a bail 41 (FIG. 2) by means of two horizontal pins 36 and 37, the axis of which is perpendicular to the axis of the hub 33 (FIG. 1). The seat 34 is thus adapted to be tilted to varying degrees in a vertical plane in such manner as to dispose any one of the five rows of types or characters 32 of the head 31 facing the platen 30.

The bail 41, in turn, is pivoted on a shaft 43 fixed to the frame 46 of the machine to bring the selected type into engagement for typing on the platen 30.

For rotation of the head 31, it is connected in known manner by a universal joint to the upper end of a shaft 51 rotatable vertically in the bail 41. At the lower end of the shaft 51 (FIG. 5) there is keyed a gear 52 meshing with a drum-shaped gear 53 turning idly on a vertical shaft 54 fixed in turn to the frame 46.

The axes of the shafts 51 and 54 lie in a plane perpendicular to the shaft 43. The meshing between the gears 52 and 53 takes place close to the shaft 43 and is maintained during the striking of the head, as will be described hereinafter. The drum-shaped gear 53 is in mesh also with a gear 55 which can turn idly on a pivot 57 fixed in its turn to a plate 58. The plate 58 (FIG. 7) is rotatable on the shaft 54 and is pivoted to a connecting rod 59 of a shift mechanism indicated generally by the reference 25, which will be described hereinafter.

The gear 55 (FIG. 1) is integral with another gear 61 meshing with a toothed sector 62 rotatable on the shaft 54. The sector 62 (see also FIG. 6) may rotate clockwise or anticlockwise in FIG. 6 by from one to four angular steps through the agency of the selector system embodying the invention indicated by the reference 20, which will also be described hereinafter, or may remain in its rest position. The drum-shaped gear 53 can thus rotate in an independent and differential manner both through the agency of the shift mechanism 25 (FIG. 7) to select the group of "upper-case" or "lower-case" characters, and through the agency of the selector system 20 to select the character in the range of the group.

For tilting the head 31 (FIG. 1), the seat 34 is connected through the medium of a connecting rod 75 to a toothed sector 76 pivoted at 77 on the arm 38 of the bail 41. The sector 76 is in mesh with a sector 78 pivoted at 79 on the frame 46 and connected in turn to the selector system 20 through the medium of a connecting rod 80. The pivots 77 and 79 are substantially coplanar with the shaft 43. The meshing point between the sectors 76 and 78 is located on the axis of the shaft 43, as a result of which it is maintained during the striking movements of the head 31.

Figure 4:
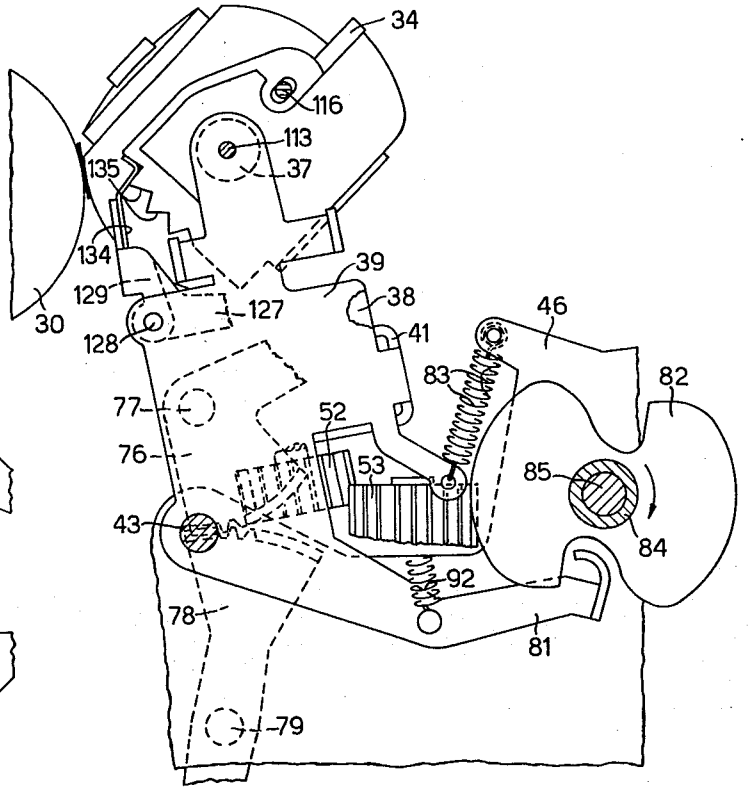
FIG. 4 shows the details of FIG. 3 in an operative position.
Figure 14:
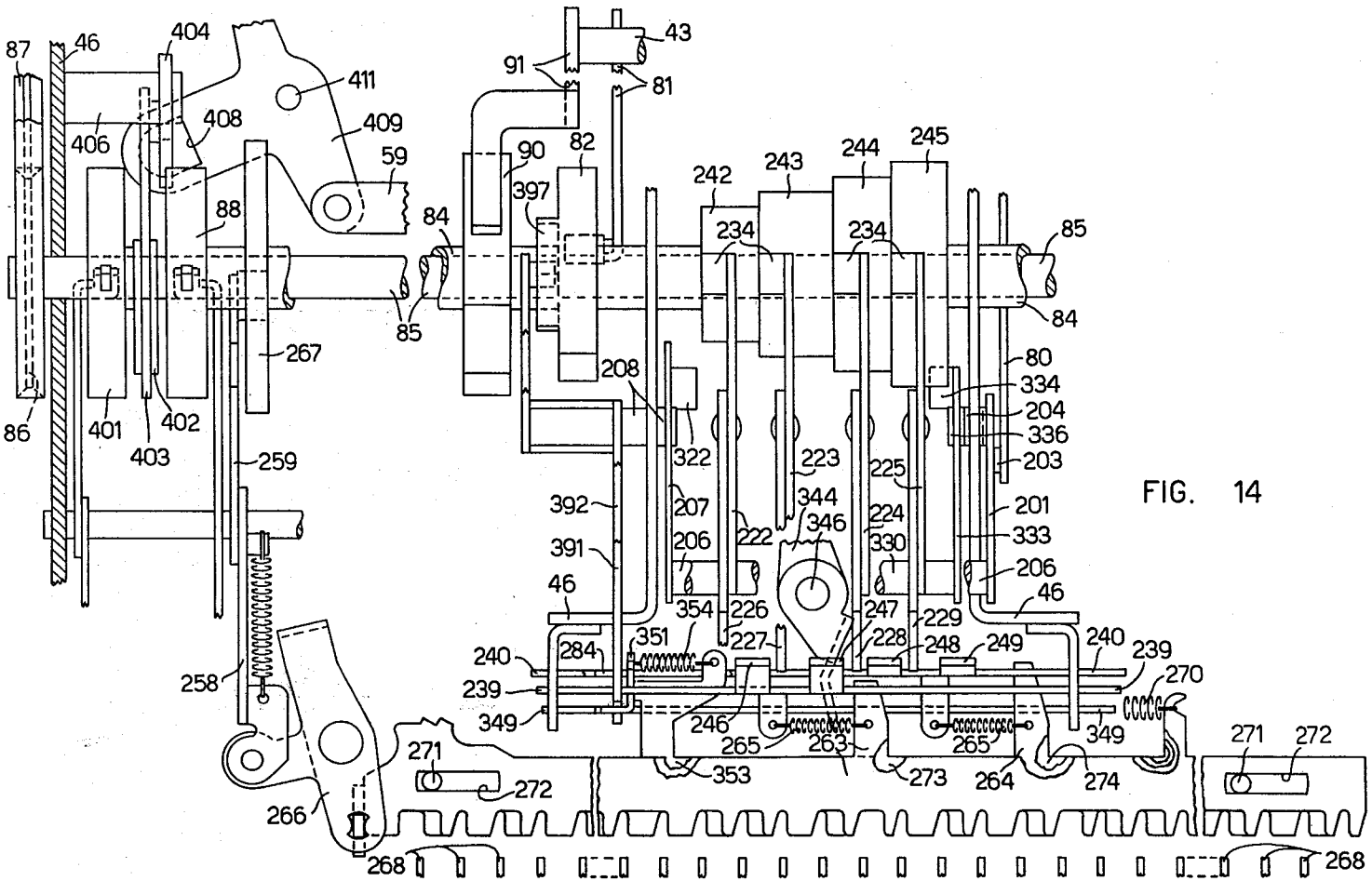
FIG. 14 is a plan view of the selector system.

For the striking movement of the head 31, the arm 39 of the bail 41 (FIG. 4) is provided in its lower part with a cam-following extension 81 which co-operates with a cam 82 under the action of two striking springs 83 stretched between the arms 38 and 39 of the bail 41 and the frame 46. The cam 82 is keyed on a hollow shaft 84 which is rotated clockwise through 180° in a manner known per se for each typing cycle through the agency of a clutch 88 (FIG. 14) having its driving part keyed on a driving shaft 85 coaxial with the shaft 84. The shaft 85 is rotated through the medium of a pulley 86 and a belt 87 by an electric motor not shown in the drawings.

Figure 3:
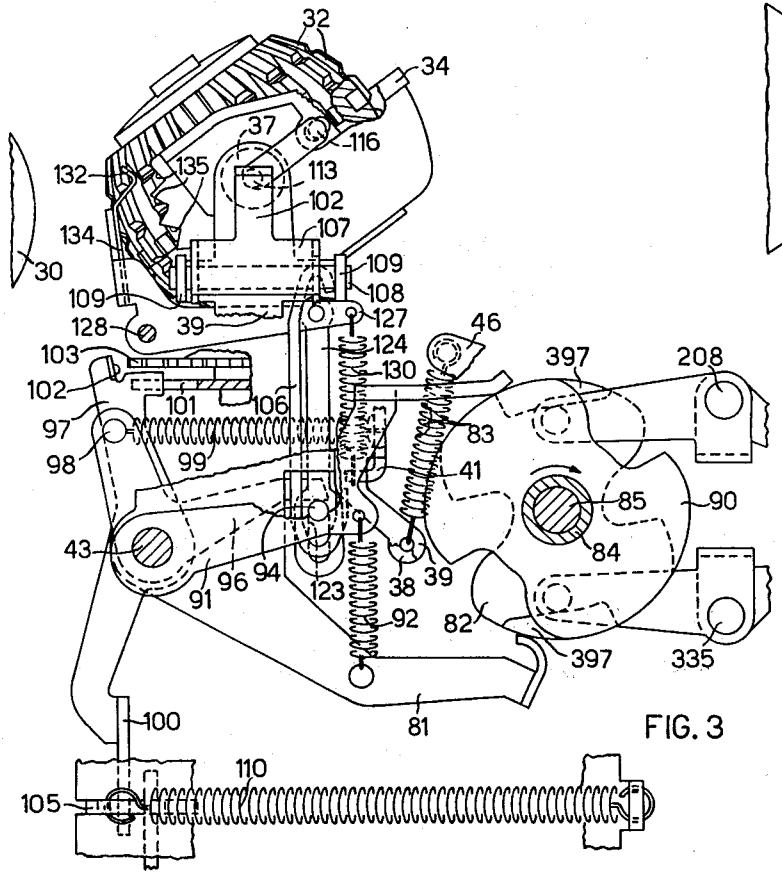
FIG. 3 is a side view showing a number of details of the selector system.

On the shaft 84 (FIG. 3) and flanking the cam 82 there is moreover keyed a truing or correcting cam 90 which co-operates with a cam follower lever 91 pivoted on the shaft 43 through the action of a spring 92 stretched between the lever 91 and the extension 81 of the bail 41.

On the shaft 43 are also pivoted a bell-crank lever 96 and a truing or correcting element constituted by a lever 97 connected to the lever 96 by a pin 98. Between the pin 98 and the bail 41 is stretched a spring 99 which keeps the bell-crank lever 96 bearing against a pin 94 fixed to the lever 91.

The lever 97 is substantially vertical and is guided at the top in a slot 101 in the bail 41. The lever 97 is provided with an edge 102 of V-shaped section which is adapted to engage corresponding slots 103 (FIG. 6) in a disc 104 keyed on the shaft 51. Each slot 103 is aligned with a corresponding column of types 32 and the depth of these slots is in relation to the typing area of the types of the corresponding column, so that to the types of greater area there corresponds a greater depth of the slot 103.

The lever 97 (FIG. 3) has at the bottom a lug 100 which normally arrests an anti-rebound lever 105 (FIG. 7) guided and fulcrumed in a slot in the frame 46. The lever 105 is provided with a shoulder 111 adapted to co-operate with the frame 46 and is pulled by a spring 110, the action of which on the lever 97 (FIG. 3) accords with that of the spring 99.

The pin 94 is embraced by the lower U-shaped end of a substantially vertical rod 106. The rod 106 is engaged at the top in an arm of a bail 107 pivoted between two lugs 109 of the arm 39 through the medium of a pin 108 located in a plane perpendicular to the platen 30. The bail 107 (FIG. 2) is provided in turn with a lug 112 which co-operates with one end of a truing or correcting element constituted by a pin 113 slidable in a corresponding axial bore 114 of the pin 37. This end of the pin 113 (see also FIG. 3) is integral with a parallel pin 116 which is guided slidably in turn in a hole 117 formed in the seat 34 of the head 31. The other end 118 of the pin 113 is V-shaped and is adapted to co-operate with corresponding V-shaped notches 119 formed between the columns of types 32 on an equatorial ring of the head 31. A compression spring 121 keeps the pin 113 normally disengaged from the notches 119 and the bail 107 arrested against the arm 39 of the bail 41 by means of a corresponding extension 122.

Figure 2:
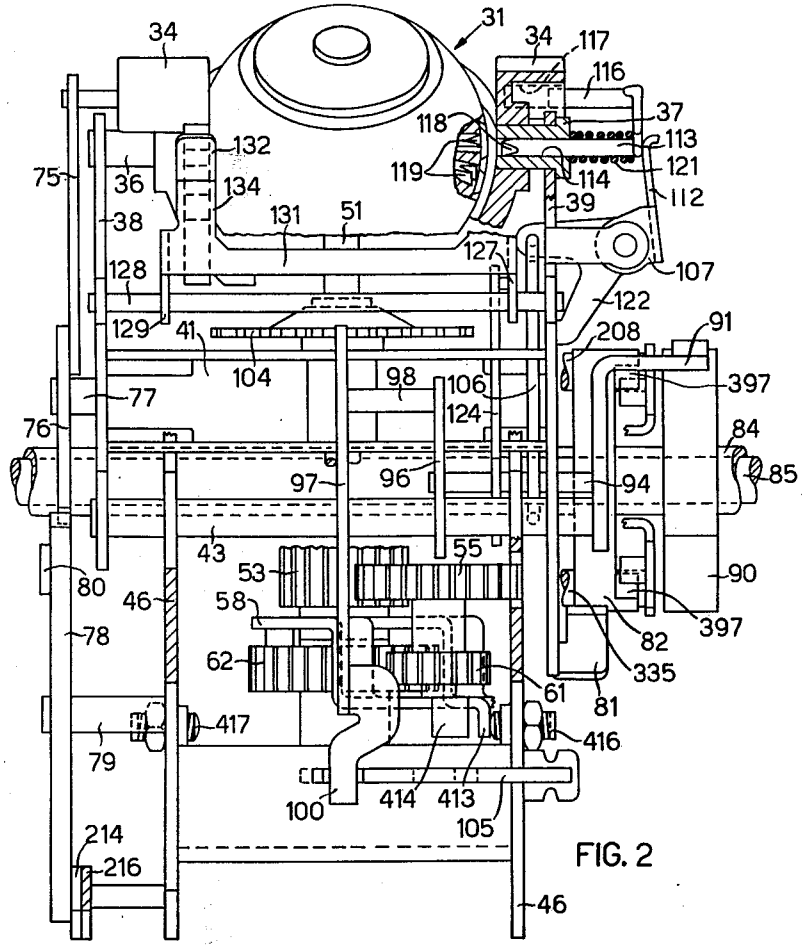
FIG. 2 is a partial front view on the line II—II of FIG. 1.

The pin 94 (FIG. 3) is finally engaged by a longitudinal slot 123 formed in the lower part of a substantially vertical connecting rod 124. This connecting rod 124 is pivoted at the top on a lever 127 pivoted on a shaft 128 parallel to the platen 30 and fixed in turn between the arms 38 and 39 of the bail 41 (FIG. 2). The lever 127 is moreover connected in bail fashion by means of a crosspiece 131 to another lever 129 also pivoted on the shaft 128. Between the lever 127 and the bail 41 there is stretched a spring 130 (FIG. 3) which holds the connecting rod 124 with the upper end of the slot 123 arrested against the pin 94. In the proximity of the arms 127 and 129 (FIG. 2) the crosspiece 131 holds two leaf springs 134 having their corresponding free ends 132 (FIG. 3) V-shaped. These ends are adapted to engage one of the five notches 135 formed in two rear lateral sides of the seat 34 (on the left in FIG. 3) and corresponding to each of the five rows of types 32.

For the printing of a character 32, the head 31 operates in the following manner:

A 180° rotation cycle of the shaft 84 (FIG. 1) having been started, during the first 60° of rotation, the selector system 20 positions the connecting rod 80 and the sector 62 in the manner to be described below. The connecting rod 80 rotates the sector 78 which, through the medium of the sector 76 and the connecting rod 75, causes the seat 34 to tilt on the pins 36 and 37 (FIG. 3), selecting the row of the character 32 to be typed. The sector 62 (FIG. 1), in turn, rotates the gear 61 and this gear, acting through the other gear 55, the drum-shaped gear 53 and the gear 52, rotates the shaft 51, selecting the column of the character 32 to be typed.

The character 32 having been selected, after a rotation of the shaft 84 through about 70°, the cam 90 (FIG. 3) presents an abrupt saddleback to the cam follower lever 91. Due to the action of the spring 92, the lever 91 then rotates clockwise and lowers the pin 94. Through the agency of the spring 99, the lever 96 thus rotates clockwise, causing the edge 102 of the lever 97 to engage the facing slot 103 in the disc 104. Through the agency of the spring 130, the lever 127, in turn, follows with the connecting rod 124 the lowering of the pin 94 and brings the ends 132 of the two leaf springs 134 into correspondence with the notches 135. At this stage, the pin 94 remains above the lower U-shaped end of the rod 106, as a result of which the rod is not affected by the movement of the pin 94.

After another brief rotation of the shaft 84, the cam 82 also presents a saddleback to the cam follower extension 81. Due to the action of the spring 83, the bail 41 then rotates rapidly anticlockwise on the shaft 43. The disc 104 is further engaged by the lever 97 until such time as the base of the slot 103 (FIG. 6) arrests the edge 102. While the connecting rod 124 (FIG. 3) is kept arrested by the pin 94, owing to the mutual movement between the shaft 128 and the lever 91, the two notches 135 are further engaged by the ends 132 of the two springs 134. The lower end of the rod 106 is now engaged by the pin 94, rotating the bail 107 (FIG. 2) anticlockwise in opposition to the action of the spring 121. The pin 113 then engages the end 118 in the corresponding notch 119, thus adjusting the position of the column of the selected character. Due to the action of the spring 110, the anti-rebound lever 105 (FIG. 7) partly follows the movement of the lever 97 until it is arrested by means of its shoulder 111 by the frame 46.

A little before the selected character 32 (FIG. 3) strikes the typing point, the edge 102 of the truing lever 97 meets the base of the slot 103. The bail 41 is now in its striking stroke to drive the lever 97 in opposition to the action of the spring 99, which thus absorbs a part of the impact energy of the springs 83. The slot 103 of greater or lesser depth therefore delays or advances the opposing action of the spring 99 on the bail 41. A little later, the lug 100 of the lever 97 re-engages the lever 105, the spring 110 of which absorbs another part of the energy of the head to reduce the time of impact with the platen 30. The impact between the lug 100 and the lever 105 also occurs later or earlier with respect to the instant of impact between the head 31 and the platen in dependence upon the greater or lesser depth of the slot 103. In consequence, the amount of energy absorbed by the springs 99 and 110 is therefore respectively lesser or greater and the striking of the head 31 against the platen 30 will be more or less forceful. Since the respectively deeper and shallower slots 103 are associated with the columns of types or characters respectively having larger and smaller typing areas, the intensity of striking of the type selected will be automatically adjusted.

During the striking of the head 31 (FIG. 4), the sector 76 moves away only a little from the sector 78, but is maintained substantially in mesh therewith. Similarly, owing to the closeness of the meshing zone between the gear 52 and the drum-shaped gear 53 to the shaft 43, the meshing action between these two gears is also substantially maintained. The selector system 20 (FIG. 1) is therefore able to provide for the selection of the fresh character 32 immediately after the typing of the previously selected character.

When the shaft 84 has rotated through about 120°, the cams 82 (FIG. 3) and 90 re-engage the extension 81 and the lever 91, respectively, bringing both the head 31 and the corresponding truing elements 97 and 113 back to the inoperative position.

SELECTOR SYSTEM

Figure 8:
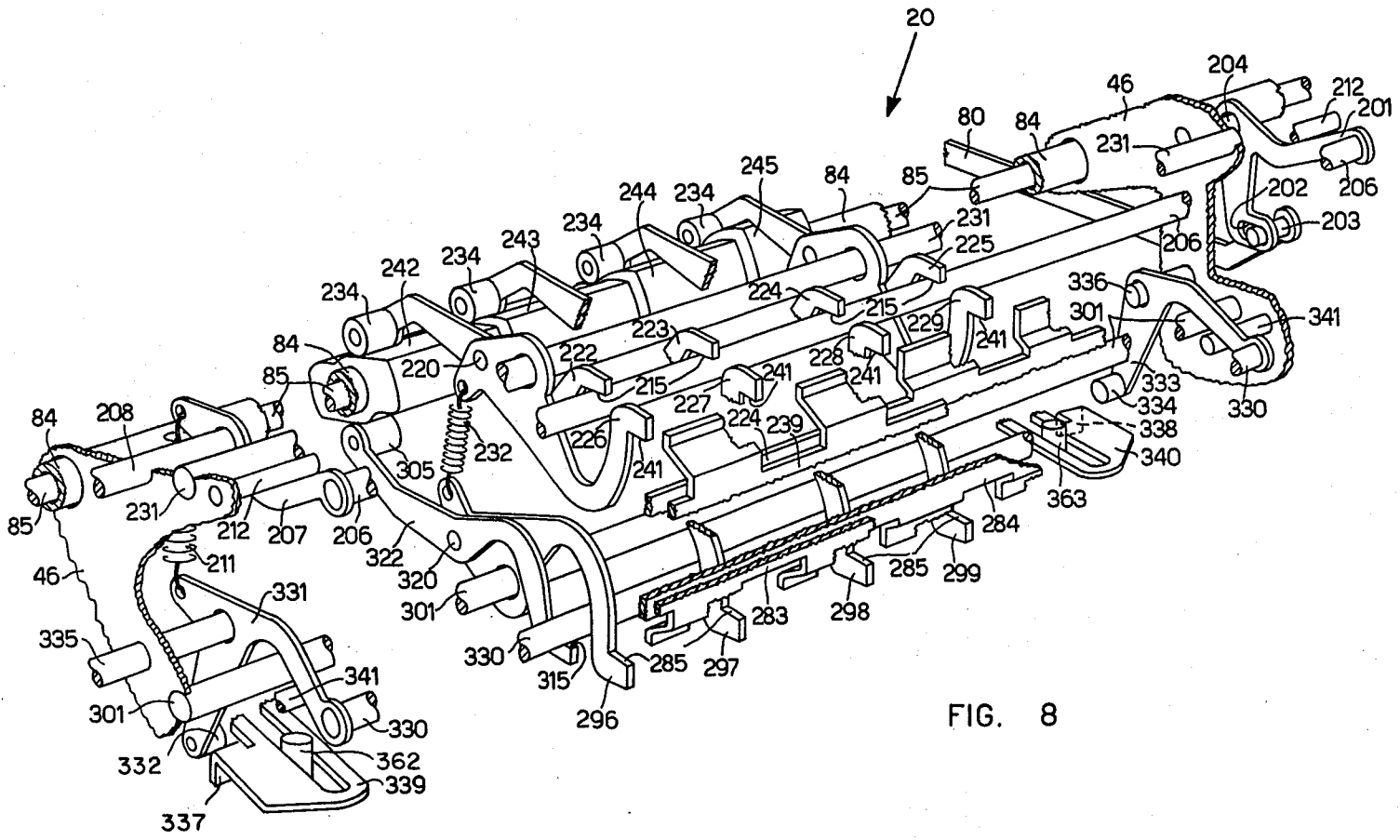
FIG. 8 is an exploded perspective view of the selector system.

Referring to FIGS. 1 and 8, the selector system 20 comprises, for the selection of the row of characters 32, a positioning member for the head 31 constituted by an arm 201 which is connected through the medium of a slotted hole 202 to a pin 203 fixed to the connecting rod 80. The arm 201 is pivoted on a pin 204 fixed to the frame 46 and is connected in bail fashion through the medium of a crosspiece 206 to another arm 207 pivoted on a pin 208 coaxial with the pin 204 and also fixed to the frame 46. Under the action of a spring 211, the bail 201, 206, 207 is held in a raised position, with the arms 201 and 207 arrested against a pair of pins 212 fixed to the frame 46. A spring 213 acting on the connecting rod 80 (FIG. 1) normally keeps the pin 203 arrested against the front end (the right-hand end in FIG. 1) of the slotted hole 202. To this position there corresponds the selection of the first row of characters 32 on the head 31. Finally, to the bottom of the sector 78 there is pivoted an arm 214 connected in toggle fashion to another arm 216 pivoted on the frame 46. Due to the action of the spring 213 on the sector 78, the arm 216 is normally aligned with the arm 214 in opposition to a spring 217 stretched between two lateral projections of the arms 214 and 216.

On the crosspiece 206 there normally bears a shoulder 215 of four cam followers constituted by like selector rocking levers 222, 223, 224 and 225 (FIG. 8). These rocking levers are respectively pivoted on pins 220 of corresponding selector members constituted by levers 226, 227, 228 and 229, which are also alike and pivoted in turn on a fixed shaft 231. Fixed to the levers 226, 227, 228 and 229 in the proximity of the pins 220 are the ends of corresponding springs 232 which hold rollers 234 on the other ends of the rocking levers 222, 223, 224 and 225 in contact with the active profiles of corresponding selector cams 242, 243, 244 and 245 keyed on the shaft 84. The total action of the four springs 232 on the levers 226, 227, 228 and 229 is less than the action of the spring 211 on the bail 207, 206, 201, as a result of which the rocking levers 222, 223, 224 and 225 resting in this way between the crosspiece 206 and the cams 242, 243, 244 and 245 define at rest a position of equilibrium of the pins 220 and, therefore, a position of rest or inoperative position of the levers 226, 227, 228 and 229.

Figure 9:
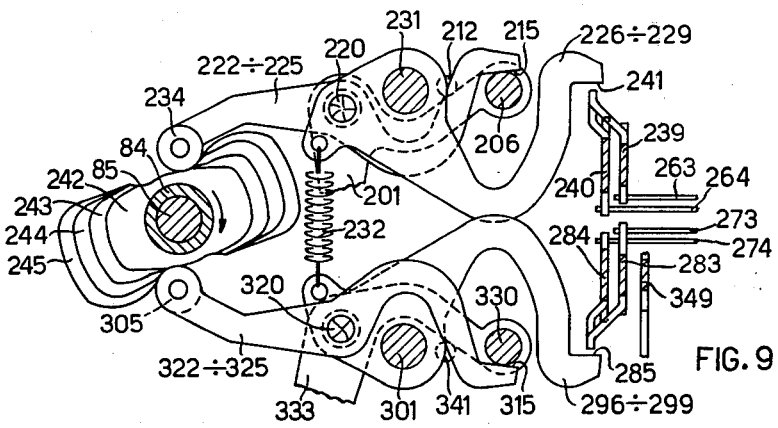
FIG. 9 is a side view of the selector system.

The cams 242, 243, 244 and 245 (FIG. 9) are of the two-lobed type and have a substantially similar low profile and a high profile increasing from the cam 242 to the cam 245 by discrete and substantially equal increments so as to form a series of steps of constant rise.

Figure 12:
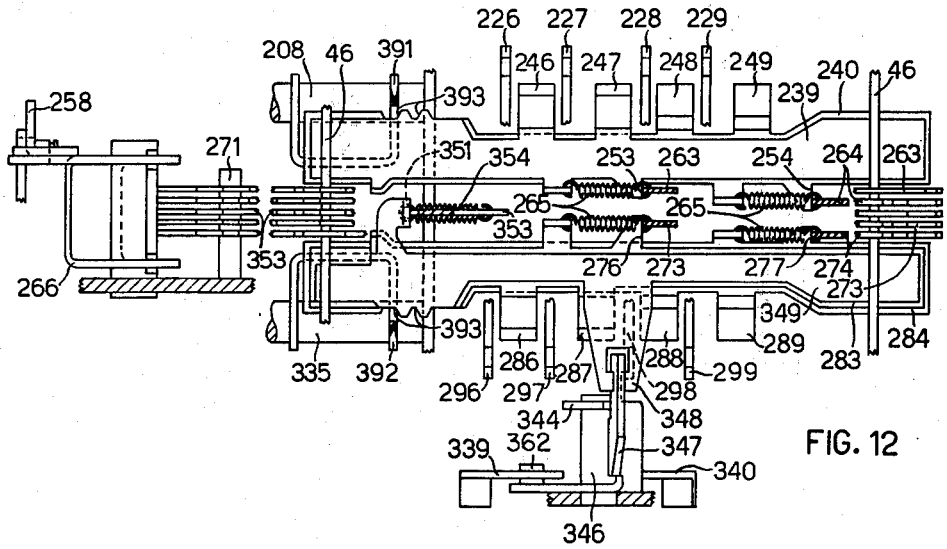
FIG. 12 is a front view on the line XII—XII of FIG. 11.

The ends of the levers 226, 227, 228 and 229 are substantially aligned with one another and have a shoulder 241 at the bottom. Each of these shoulders 241 is normally disposed above, and is adapted to co-operate with, a corresponding upper tooth of two selector sliders 239 and 240. More particularly, referring to FIG. 12, the levers 226 and 227 are respectively adjacent the two teeth 246 and 247 of the slider 239, while the levers 228 and 229 are respectively adjacent the two teeth 248 and 249 of the slider 240. These sliders 239 and 240 are provided at the bottom with shoulders 253 and 254, respectively. Each of the shoulders 253 and 254 normally co-operates with a lateral projection of a corresponding bar 263 and 264 through the action of corresponding springs 265 stretched between the lateral projections of the bars 263 and 264 and the sliders 239 and 240.

The selector bars 263 and 264 (FIG. 14) are longitudinally parallel to but in planes perpendicular to the sliders 239 and 240 and are disposed substantially below these sliders, being guided by means of fixed pins 271 and slotted holes 272. The bars 263 and 264 are normally arrested by the action of corresponding springs 270 against a reloading bail 266. On this bail 266 (FIG. 13) is pivoted a connecting rod 258 connected in turn by a pin and slot to a cam follower lever 259 rotatable on a shaft 260 and which, through the action of a spring 261, co-operates with a cam 267 keyed on the shaft 84. In each typing cycle, the bail 266 releases the bars 263 and 264 (FIG. 14) and the springs 270 shift these bars to the left in the drawing. Corresponding stops 268, which are set in known manner under the control of keys or electromagnets not shown in the drawing, are moreover adapted to arrest these bars 263 and 264 after a movement of one or two steps or alternatively to hold them at rest. In this way, the slider 239 is adapted respectively to bring the tooth 246 into the path of the lever 226, to bring the teeth 246 and 247 into the paths of the levers 226 and 227 or to leave both teeth clear of the levers. Similarly, the slider 240 is adapted to bring the tooth 248 or the teeth 248 and 249 into the path of the lever 228 or the levers 228 and 229 or to leave both teeth clear of the levers.

Stacked parallel to the bars 263 and 264 and guided by the pins 271 and the slots 272 are another two bars 273 and 274 which provide for the selection of the columns of characters. The bars 273 and 274 are also under the control of the bail 266 and the stops 268 and can be shifted up to two steps to the left by the action of corresponding springs 270. Through the medium of corresponding lateral projections and springs 265 (FIG. 12), the bars 273 and 274 arrest corresponding shoulders 276 and 277 of another two selector sliders 283 and 284 similar to the sliders 239 and 240 and disposed substantially in line with the latter, but below the bars 273 and 274.

Each of the sliders 283, 284 is provided on its bottom edge with two teeth 286 and 287 and 288 and 289, respectively, which, in correspondence with the movements of the sliders 283, 284, are adapted to retain a shoulder 285 (FIG. 8) of two selector levers 296 and 297 and of another two selector levers 298 and 299, respectively. These levers 296, 297, 298 and 299 (FIG. 9) are identical to the levers 226, 227, 228 and 229 and are disposed symmetrically thereto with respect to a horizontal plane extending through the axis of the shaft 84.

The levers 296, 297, 298 and 299 (see also FIG. 8) are pivoted on a fixed shaft 301 which is also symmetrical with respect to the shaft 231 and receive pivotally, by means of pins 320, corresponding selector rocking levers 322, 323, 324 and 325 identical in turn to the rocking levers 222, 223, 224 and 225. The same springs 232 which act by means of one end on the the upper levers 226, 227, 228 and 229 act by means of the other end on the lower selector levers 296, 297, 298 and 299 and hold a corresponding roller 305 carried by an arm of these rocking levers 322, 323, 324 and 325 so that it bears against the same cams 242, 243, 244 and 245. The other arm of the rocking levers 322, 323, 324 and 325 is supported in turn by means of a shoulder 315 against a crosspiece 330 of a bail, the arms 331 and 333 (FIG. 8) of which are pivoted on two pins 335 and 336 fixed to the frame 46.

To the arms 331 there is moreover fixed the other end of the spring 211, which thus tends to cause the bail 331, 330, 333 to turn clockwise. The action of the four springs 232 on the levers 296, 297, 298 and 299 is also less than the action of the spring 211 on the bail 331, 330, 333, as a result of which the arms 331 and 333 are normally arrested against a pair of pins 341 fixed to the frame 46. The rocking levers 322, 323, 324 and 325 (FIG. 9) held at rest in this way between the cams 242, 243, 244 and 245 and the crosspiece 330 define a position of equilibrium of the pins 320 and, therefore, a position of rest of the levers 296, 297, 298 and 299.

Each of the two arms 331 and 333 (FIG. 8) bears a rotatable roller 332, 334, respectively, each of which rollers is adapted to co-operate with a corresponding lug 337, 338, respectively, of connecting rods 339 and 340, respectively. The connecting rods 339 and 340 (FIG. 6) are pivoted to corresponding arms 342 and 343 of the sector 62 and are each provided with a slotted hole 359, 361 slidably engaged by corresponding pins 362 and 363. These pins are fixed to a lever 344 (FIG. 12) rotatable on a spindle 346 fixed to the frame 46. A lug 347 of the lever 344 is engaged in turn by a corresponding fork 348 of another selector slider 349. The lever 344 (FIG. 6) normally holds the lug 337 of the connecting rod 339 in the path of the roller 332 and the lug 338 of the connecting rod 340 clear of the path of the roller 334.

The selector slider 349 (FIG. 12) is alongside the sliders 283 and 284 and is provided with a lug 351 which is arrested against a lateral projection of the remaining selector bar 353 under the action of a spring 354 stretched between the lug 351 and the bar 353. The bar 353 is stacked parallel to the other bars 263, 264, 273 and 274 on the pins 271 (FIG. 14) and is adapted to shift to the left under the control of the bail 266 and of a corresponding spring 270 to be arrested by the set stops 268 either on the spot or after a movement to the left by one step. In the latter case, through the medium of the slider 349 and the lever 344, the bar 353 is adapted to bring the lug 337 (FIG. 6) beyond the path of the roller 332 and the lug 338 into the path of the roller 334.

The sector 62 is also provided with a projection 371 centred between the arms 342 and 343 and fitting between two lugs 373 and 374 of two corresponding levers 376 and 377 pivoted on the shaft 54. Two springs 378 and 379 fixed between the frame 46 and the levers 376 and 377, respectively, hold the levers 376 and 377 normally arrested against a lug 381 of the frame 46 and keep the sector 62 centred, so as to dispose the central column of characters 32 in front of the platen 30 (FIG. 1).

Figure 11:
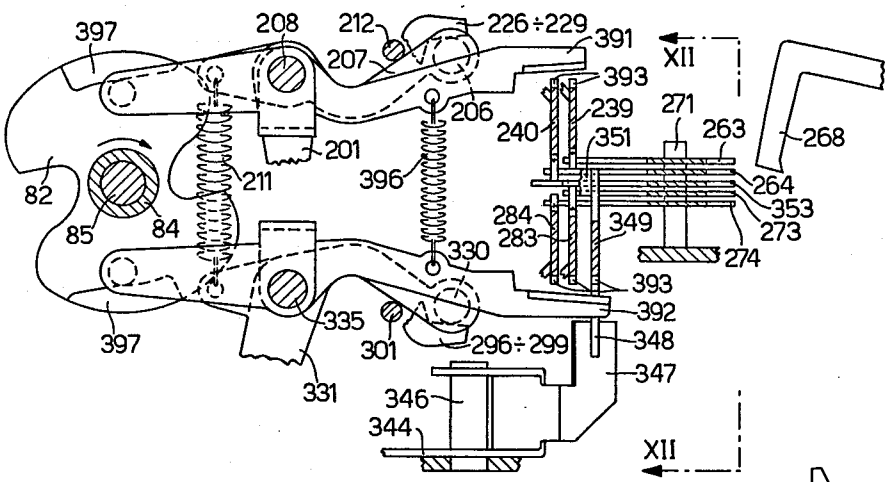
FIG. 11 is another side view of other details of the selector system.

Finally, two positioning levers 391 and 392 (FIG. 11) pivoted on the pins 208 and 335, respectively, are adapted to engage a series of notches 393 (FIG. 12) in the upper selector sliders 239 and 240 and the lower selector sliders 283, 284 and 349. More particularly, the two levers 391 and 392 (FIG. 11) secure the ends of a spring 396, which biases two corresponding rollers of the levers 391 and 392 to co-operate with inwardly facing surfaces of two lobes 397 formed on the cam 82. The shape of the two lobes 397 is such that the two levers 391 and 392 are normally disengaged from the notches 393 of the five sliders 239, 240, 349, 283 and 284.

The selector system 20 (FIG. 14) operates in the following manner:

By depressing a key or activating an electromagnet (not shown in the drawings), one of the stops 268 is set, locking or engaging the clutch 88 and starting the shaft 84 in known manner for a clockwise cycle of 180°. In the first stage of rotation, the cam 267 (FIG. 13), acting by means of a steep profile thereof, causes the lever 259 to rotate rapidly anticlockwise. The bail 266 (FIG. 14) then releases the five code bars 263, 264, 353, 273 and 274, which are arrested in combination on the spot, or after a movement to the left by one step or, with the exception of the bar 353, after a movement to the left by two steps. The lobes 397 (FIG. 11) also present a rapidly decreasing profile to the levers 391 and 392. The levers 391 and 392 therefore rotate clockwise and anticlockwise, respectively, engaging the notches 393 of the sliders 239, 240, 349, 273 and 274, arresting them in the positions reached.

After a rotation of the shaft 84 (FIG. 9) through about 30°, the cams 242, 243, 244 and 245, presenting their high profile, raise the rollers 234 of the corresponding rocking levers 222, 223, 224 and 225 and lower the rollers 305 of the rocking levers 322, 323, 324 and 325. Since the combined action of the four springs 232 on the levers 226, 227, 228 and 229 is less than that of the springs 211 (FIG. 8) on the bail 201, 206, 207, the crosspiece 206 remains stationary and the rocking levers 222, 223, 224 and 225 begin to rotate clockwise fulcrumed on the crosspiece 206. Similarly, the bail 333, 330, 331 remains stationary and the rocking levers 322, 323, 324 and 325 rotate anticlockwise fulcrumed on the crosspiece 330. Through the medium of the pins 220 the levers 226, 227, 228 and 229 are then rotated clockwise about the shaft 231. The shoulders 241 are thus lowered at the same time, while the shoulders 285 are raised.

Referring to the selection of the rows of characters 32 (FIG. 1), in the event of the stop 268 having left the bars 263 and 264 stationary, no tooth of the sliders 239 and 240 is disposed in the path of the levers 226, 227, 228 and 229. The shoulders 241 can thus be lowered freely, while the crosspiece 206 remains in the rest position. The first row of characters 32 (FIG. 1) is thus selected.

If a corresponding tooth of the sliders 239, 240 is disposed in the path of the shoulders 241 (FIG. 9), after the shoulder 241 has taken up the clearance separating it from the corresponding tooth it cannot be lowered further. Consequently, the respective lever 226, 227, 228 and 229 and the respective pin 220 remain in a position of arrest. Since the sole degree of freedom of the rocking lever 222, 223, 224 and 225 corresponding to the arrested lever 226, 227, 228 and 229 is now represented by a rotation about the pin 220, the raising of the rollers 234 produced by the high profile of the cams 242, 243, 244 and 245 causes the positive lowering of the corresponding shoulder 215 and, therefore, the clockwise rotation of the bail 201, 206, 207 (FIG. 8) in opposition to the action of the spring 211. According to which of the levers 226, 227, 228 and 229 has been arrested, after a 70° rotation of the shaft 84, the bail 201, 206, 207 is thus lowered positively by one, two, three and four angular steps, respectively. The connecting rod 80 (FIG. 1) is therefore shifted to the left in the drawing in opposition to the action of the spring 213, positioning the corresponding row of characters 32 in front of the platen.

Figure 10:
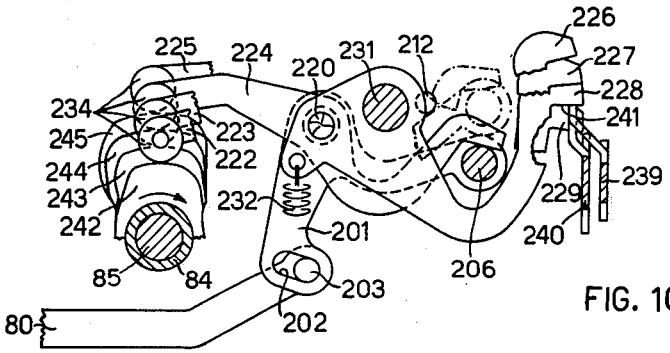
FIG. 10 shows a number of parts of FIG. 9 in an operative position.

The rocking levers 222, 223, 224 and 225 (FIG. 10) corresponding to the levers 226, 227, 228 and 229 which are locked are disposed in their turn between the new position of the crosspiece 206 and the high profile of the cams 242, 243, 244 and 245. More particularly, it has been assumed in FIG. 10 that the shoulder 241 of the lever 228 has been arrested. The rocking lever 224 then lowers the crosspiece 206 positively by three steps. At the same time, the pins 220 corresponding to the rocking levers 222 and 223 are lowered with respect to the pin 220 of the rocking lever 224, while the pin 220 of the rocking lever 226 is raised. The levers 226 and 227 therefore rotate anticlockwise and rise with respect to the lever 228, while the lever 229 rotates clockwise and is lowered with respect to the lever 228.

Referring to the selection of the columns of characters 32 (FIG. 1), together with the bars 273 and 274, the stops 268 also position the bar 353 and, therefore, the slider 349. The lever 344 (FIG. 6) can therefore remain in place and then leaves the lug 337 of the connecting rod 339 in the path of the roller 332, or it can be rotated clockwise and then brings the lug 338 of the connecting rod 340 into the path of the roller 334.

In similar manner to what has been described for the rocking levers 222, 223, 224 and 225 (FIG. 9), the rollers 305 of the rocking levers 322, 323, 324 and 325 are lowered by the high profile of the cams 242, 243, 244 and 245. In the event of no tooth being located in the path of the shoulders 285 of the levers 296, 297, 298 and 299, the rocking levers 322, 323, 324 and 325 are confined to rotating fulcrumed on the crosspiece 330, leaving the arms 333, 331 (FIG. 1) at rest. The head 31 remains at rest and selects the central column of characters 32 in front of the platen 30.

Figure 6:
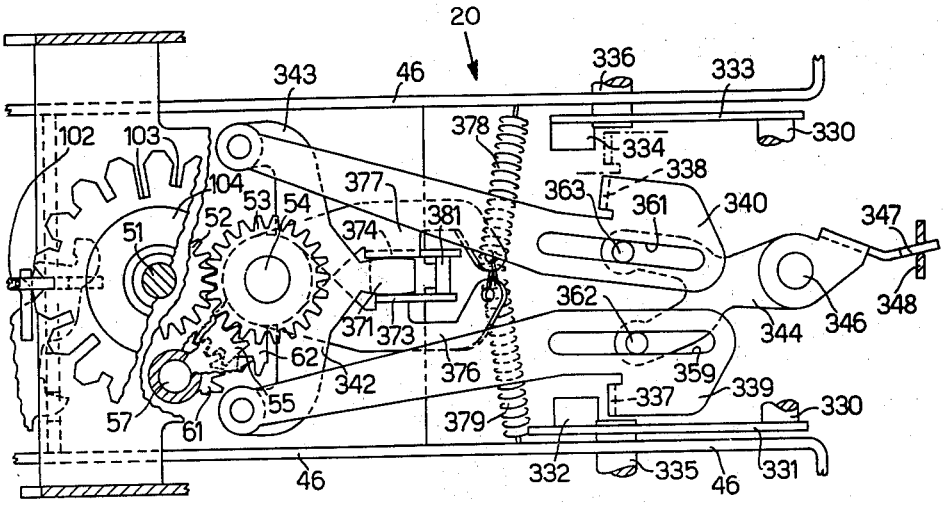
FIG. 6 is a partial plan view showing a number of details of FIGS. 1 and 2.

In the event of the stop 268 positioning the bars 273 and 274 in such manner that the sliders 283 and 284 bring a tooth into the path of the shoulders 285 (FIG. 9) of the levers 296, 297, 298 and 299, the corresponding lever is arrested. The pin 320 fixed to this lever is then locked, producing the corresponding positive rotation of the bail 333, 330, 331 (FIG. 6). The rollers 332 and 334 then shift to the right in the drawing, carrying along the connecting rod 339 or 340, the lug 337 or 338 of which is disposed in the path of the said rollers 332 and 334. The sector 62 is thus rotated anticlockwise or clockwise. In the first case, the projection 371 pushes the lug 374 of the lever 377 upwardly in the drawing in opposition to the action of the spring 379, while the lug 373 continues to bear on the lug 381. In the second case, the lug 373 of the lever 376 is shifted downwardly in opposition to the action of the spring 378, while the lug 374 continues to bear against the lug 381 of the frame 46. Through the medium of the gears 61 and 55 (FIG. 1), the drum-shaped gear 53 and the gear 52, the head 31 is rotated correspondingly anticlockwise or clockwise by one to four angular steps, selecting the corresponding columns of characters 32 in front of the platen 30.

After a rotation of the shaft 84 (FIG. 9) through about 90°, the rocking levers 226, 227, 228 and 229 and the rocking levers 322, 323, 324 and 325 reach a position of arrest which they maintain until the shaft 84 has rotated through about 130°. During this period, the printing of the selected character takes place in the manner hereinbefore described.

Owing to the action of the cam 267 (FIG. 13) on the lever 259, the reloading bail 266 has moreover provided for the recovery of the bars 263, 264, 273, 274 and 353 in opposition to the action of the springs 270 (FIG. 14), to prearrange them for a fresh setting by the stops 268. The corresponding sliders 239, 240, 283, 284 and 349 (FIG. 12), on the other hand, have remained in the selection position reached, being arrested by the action of the positioning levers 391 and 392 on the notches 393 of the said sliders. The sliders shifted by one or two steps have thus stretched the springs 265 and the spring 354 providing connection with the corresponding selector bars, while the bars have been brought back to rest position.

From about 130° to 180° of the rotation of the shaft 84 (FIG. 1), the cams 242, 243, 244 and 245 present their decreasing profiles to the rollers 234 and 305 of the corresponding rocking levers. The crosspieces 206 and 330 return to the rest positions through the action of the spring 211 and thereafter the lobes 397 (FIG. 11) also cause the positioning levers 391 and 392 to release the selector sliders which, due to the action of the springs 265 (FIG. 12), return to be arrested against the corresponding selector bars.

Through the action of the spring 213 (FIG. 1), the connecting rod 80 follows the movements of the arm 201 and by means of the sectors 78 and 76 tilts the head 31 towards its rest position. The connection produced by means of the pin 203 and the slot 202 permits the head 31 to follow the return to rest of the arm 201 with a slight delay. The toggle comprising the two arms 214 and 216 and the spring 217, aligning the arms 214 and 216 in the proximity of the rest position of the head 31, prevents possible rebound originating from the striking of the pin 203 against the far end of the slot 202.

Due to the action of the spring 378 or 379 (FIG. 6), the lug 337 or 338 of the connecting rod 339 or 340 follows the movements of the roller 332 or 334 and, through the sector 62, the gears 61, 55, the drum-shaped gear 53 and the other gear 52, rotates the head 31 (FIG. 1) towards its centred rest position. In this position, the lug 373 or 374 (FIG. 6) is arrested by the lug 381 of the frame 46, so that at the end of the 180° cycle of the shaft 84 (FIG. 13) the various kinematic trains are all brought back to the rest or inoperative state.

SHIFT

Figure 13:
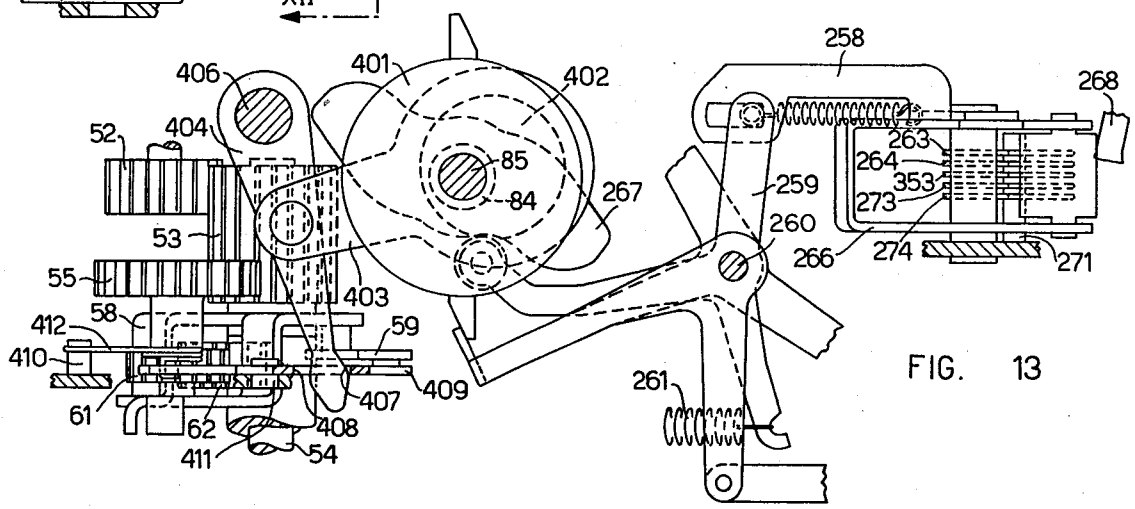
FIG. 13 is a side view showing further details of the selector system.

Referring to FIG. 13, the shift mechanism comprises a clutch 401 the driving part of which is fixed on the shaft 85 and to the driven part of which there is keyed an eccentric 402.

A connecting rod 403 co-operates with the eccentric 402, the connecting rod being connected to a lever 404 pivoted on a fixed spindle 406. The lever 404 is provided with a projection 407 engaged with a wide clearance in a hole 408 in a crank 409 (FIG. 14) pivoted on a pin 411 fixed to the frame 46. The crank 409 is connected to the connecting rod 59 and holds one end of an expansion spring 412 (FIG. 7), the other end of which is fixed on a pin 410 of the frame and which acts as an unbalance spring.

Due to the action of the spring 412 on the crank 409, the plate 58 is normally held arrested by a left-hand lug 413 or a right-hand lug 414 against a corresponding stop screw 416 or 417 fixed to the frame 46 on opposite sides. Under normal conditions, the eccentric 402 (FIG. 13) is located in a position of minimum lift in which it keeps the lever 404 shifted to the right in the drawing and the plate 58 (FIG. 7) rotated anticlockwise, with the lug 413 arrested against the screw 416. Under these conditions, the head 31 (FIG. 1) presents its face corresponding to the "lower-case" types or characters in front of the platen 30.

By activating the clutch 401 (FIG. 7) for a cycle of 180°, the lever 404 is rotated clockwise. After taking up the clearance between the projection 407 and the walls of the hole 408, the lever 404 causes the crank 409 to rotate clockwise together with the plate 58. Since the toothed sector 62 is stationary, the gear 61 rotates with respect to the pivot 57 and, through the medium of the gear 55 and the drum-shaped gear 53, transmits the motion of the other gear 52 (FIG. 1).

Up to a rotation of the plate 58 (FIG. 7) through about 45°, which brings the two lugs 413 and 414 into a substantially centred position with respect to the screws 416 and 417, the eccentric 402 rotates the lever 404 in opposition to the action of the spring 412, which is compressed. This position having been passed, the spring 412 tends to cause the crank 409 to rotate clockwise and now acts in such manner as to facilitate the rotation of the plate 58 until the lug 414 is arrested against the screw 417. Under these conditions, the head 31 (FIG. 1) presents the face corresponding to the "upper-case" types or characters to the platen 30. The further rotation of the eccentric 402 (FIG. 7) still shifts the lever 403 clockwise and causes the projection 407 to gain part of the clearance with respect to the corresponding hole 408 until the clutch 401 is deactivated.

The eccentric 402 then remains, in known manner, in the position of maximum lift until there is a following upper case to lower case transport cycle. With the new (upper case) configuration of the plate 58 and the gears 55 and 61, the following selection of "upper-case" characters takes place in the manner hereinbefore described. The rotation of the head 31 by up to four angular steps in the two directions thus gives rise to the selection of each of the nine columns of "upper-case" characters.

While there have been described and pointed out the preferred embodiment of the invention, it will be understood that various substitutions and changes in the illustrated form and details of the device may be made by those skilled in the art without departing from the spirit of the invention. It is the intention, therefore, to be limited only by the scope of the following claims.

What I claim is:

1. A selector system for a type-bearing element of typewriters, teleprinters, accounting machines and the like office machines comprising an output member connected to the type-bearing element and shiftable for the positioning thereof; a series of cams actuatable between a rest and an operative position; a series of cam follower members associated with said actuatable cams, each cam follower member of said series including a cam follower element cooperative with an associated cam of said series of cams, an output element operatively connected to said output member, and a pivotable element, said cam follower element being positively movable by the associated cam upon actuation thereof in said operative position; support means for freely supporting said cam follower members such that when said cam follower element is moved by the associated cam, the corresponding output element is inoperative over said output member; and selectively actuatable arrest means for arresting the pivotable element of one cam follower of said cam follower members for causing the output element of said one cam follower to positively shift the output member upon positive movement of the cam follower element of said one cam follower by the associated cam actuated in said operative position.

2. A selector system as in claim 1, wherein the pivotable element of each of said cam follower members includes a pivot element and wherein said arrest means include a series of selector members, means supporting said selector members and a series of stop elements, each one selectively movable in a corresponding set position, each of said selector members being pivotally connected with the pivot element of one associated of said cam follower members and being arrestable selectively by the stop element moved in said set position.

3. A selector system as in claim 2, wherein each selector member of said series comprises a selector lever of a series of selector levers and said means supporting said selector members comprise a corresponding fixed pivot about which each of said selector members is pivoted.

4. A selector system as in claim 3, wherein the cams of said series have different lifts, and wherein the cam follower members are substantially alike, said selector levers being alike and said fixed pivot of each selector lever being constituted by a shaft common to said series of selector levers.

5. A selector system as in claim 1, wherein the output member comprises a bail member pivoted on a fixed axis, further comprising a fixed stop cooperative with said bail member and a return spring for normally holding said bail means arrested against said fixed stop, the output element of said one cam follower cooperating with said bail member for shifting the same when the cam follower element of said one cam follower is moved by the associated cam in the operative position thereof in opposition to the action of said return spring and said return spring pulling said bail towards said fixed stop when the cam follower element of said one cam follower is returned at rest in the rest position of said associated cam.

6. A selector system as in claim 5, wherein each of said series of cam follower members comprises a rocking lever, said cam follower element including an arm of said rocking lever cam following a profile of the associated cam and said output element including another arm of said rocking lever normally bearing on said bail through the action of corresponding springs and against the action of the return spring over said bail, the total action of said springs being less than the action of the said return spring over said bail.

7. A selector system as in claim 1, wherein said type-bearing element is selectable in accordance with two coordinates, said output member positioning said type-bearing element through one of said two coordinates and wherein each cam of said series of cams includes two diametrically opposed lobes rotated by a common supporting shaft, said series of cam follower members having associated therewith a second series of cam follower members, the cam follower members of said first series and of said second series lying on sides of said cams diametrically opposite with respect to the supporting shaft, for enabling the cam follower members of said first series and of said second series to co-operate with both lobes of said cams upon rotation of said supporting shaft, another output member being provided for connecting the second series of cam followers to the type-bearing element for the positioning thereof through the other of said two coordinates.

8. A selector system as in claim 1 further comprising cyclically operated motive means for actuating said cams from said rest to said operative position; a corresponding series of selector bars; selecting means operated by said motive means for yieldably moving said bars from a rest position to operative positions along predetermined path thereof; a group of setting elements selectively settable in the path of said selector bars for arresting said bars in combinations of positions; a group of springs connecting said bars with said sliders for positioning said sliders upon positioning of said selector bars so that one of said stops is selectively positioned to arrest the pivotable element of said one cam follower; restoring means operated by said motive means for returning said bars from said operative positions to said rest position; and positioning means also operated by said motive means for arresting said sliders in said combinations of positions, during the return of said bars from said operative positions to said rest position.

9. In a selector system for typewriter machines, teleprinters, accounting machines and the like office machines comprising a type-bearing element including two zones in which are distributed two corresponding groups of types; differential gear means including an output member connected to the type-bearing element for selecting said types and two input members; a transport mechanism connected to a first member of said input members for selecting one of said two zones; and a selector mechanism connected to a second member of said input members for selecting a type in said one of said two zones, the combination comprising:

a driven member operative over the first member of said differential gear means;

a bistable spring acting over said driven member, said spring having two operative configurations and an inoperative configurations of equilibrium between said two operative configurations;

a pair of stop elements cooperative with said driven member, said bistable spring, in each of said two operative configurations causing the driven member to be arrest by one or the other of said stop elements in two stable positions, in each of which there is selected one or another of said two zones;

a driving member actuatable between two different locations; and lost motion connecting means for connecting said driving member with said driven member, said driving member, when actuated from one to another of said locations, causing the driven element to be shifted from one of said stable positions to one intermediate position, against the action of said spring, beyond the inoperative configuration thereof and said lost motion connecting means enabling said bistable spring to further shift said driven member from the intermediate position to the other of said stable positions.

10. A system as in claim 9, wherein the output member of said differential gear means comprises an output gear and the first and the second members comprise corresponding first and second gear of said differential means connected with said output gear, said driven member comprising a support of one of said first and second gears rotatable on a fixed shaft, said support being provided with corresponding parts arrestable by said pair of stops in each of said stable positions, said support being connected to said driven member for being rotated thereby and said output gear being connected to said type-bearing element for the positioning thereof.

11. A system as in claim 10, wherein said support is connected through the medium of a connecting rod to a crank on which the bistable spring is operative, said lost motion connection comprising a pin and slot connection between said rod and said driving member.

12. A system as in claim 9, wherein said driving member comprises an eccentric actuated by a driven part of a cyclically operable clutch.

13. A selector system for typewriter machines or the like machines comprising a frame; a cylindrical platen; a type-bearing element comprising a shell including a substantially spherical outer surface and an inner surface of rotations, said outer surface carrying a series of types distributed in rows and columns selectable in front of said platen; a support member including a sleeve rotatably supporting the inner surface of said shell and at least two side walls fixedly connected to said sleeve and extending outside the shell; first selection means rotating said shell with respect to the sleeve of said support member for selecting the columns of types; a base member embracing said two side walls; first pivot means pivotally supporting said side walls on said base member parallel to the platen and perpendicularly to said sleeve; second selection means tilting the side walls of said support member with respect to said base member for selecting the rows of types; second pivot means pivotally supporting said base member on the frame along an axis parallel to the platen; and striking means pivoting the base member with respect to the frame for striking the selected type against said platen.

14. A system as in claim 13, wherein said shell comprises a substantially cylindrical sleeve provided with radial ribs having substantially circular external profiles defining said substantially spherical surface, in each of said ribs being embossed the types of one corresponding of said columns.

15. A system as in claim 13, wherein said first selection means comprise a pair of mutually meshing gears; first bearing means for rotatably supporting a first of said gears with respect to said base member along an axis lying in a plane perpendicular to the axis of said second pivot means; means connecting said first gear to said shell for the rotation thereof; second bearing means for rotatably supporting the second of said gears with respect to the frame along another axis lying in said plane; and a first selection mechanism connected to said second gear for the positioning thereof, said pair of gears meshing along surfaces near the axis of said second pivot means for remaining substantially meshed during pivoting of said base member with respect to the frame.

16. A system as in claim 13, wherein said second selection means comprise a pair of mutually engaging toothed sectors; third pivot means for pivoting a first of said sectors with respect to said base parallely to said first pivot means; a rod member pivotally connecting said first sector with one of said side walls for the tilting of said sleeve; fourth pivot means for pivoting the second of said sectors on the frame; and a second selector mechanism connected to said second sector for the positioning thereof, said pair of sectors being engaged along surfaces parallel to said platen and substantially coplanar with the axis of said second pivot means.

17. A system as in claim 13, wherein at least one of said side walls of the support member is provided with a series of notches opposite said platen, further comprising a positioning element, located between said notches and the platen, and for engaging one of said notches upon pivoting of the base member, to true the positioning of the selected row of characters before the striking thereof against the platen.

18. A system as in claim 13, wherein said shell comprises, in an equatorial zone thereof, a series of notches interposed between two adjacent of said columns of types, further comprising a positioning pin slidable coaxially with said first pivot means and cooperative with said notches to true the angular position of the said shell.

19. A system as in claim 18, wherein said notches have a substantially V-shaped profile, said positioning element comprising a truing pin having a corresponding V-shaped end for cooperating with the said notch and a guide pin parallel to the said truing pin slidable in a hole of said support.

20. A selector system for typewriters, teleprinters, accounting machines and the like office machines comprising a frame; a platen mounted on the frame; a type-bearing element including a plurality of types; a selection member pivoted on the frame and connected to said element for selecting one of said types in front of said platen; an output member positively positionable from a rest position to different selection positions; means connecting said output member with said selection member, for the selection of said types starting from the rest position of said output member, said means including a lost motion connection; spring means operative over said selection member for returning said selection member in said rest position, through said lost motion connection, upon returning at rest of said output member; and a pair of levers connecting in a toggle fashion said selection member with the frame, said levers being substantially aligned in the rest position of said selection member to dampen positively any rebound of said lost motion connection upon returning of said selection member in said rest position.

21. A selector system according to claim 20, further comprising a spring element operative over said levers for urging them toward a predetermined direction, the action of said spring means over said selection member being stronger than the corresponding action of said spring element.

22. A type-bearing element carrying a series of types distributed over a surface substantially spherical in shape in columns for a selector system of a typewriting machine of the type comprising a cylindrical platen; a support member for rotatably supporting said type-bearing element; first selection means rotating said type-bearing element with respect to said support member for selecting in front of said platen the columns of types; a base member including pivot means for pivotally supporting said support member parallel to the platen; second selection means tilting said support member with respect to said base member for selecting in front of said platen the rows of types; and striking means operating over the base member for striking the selected type against said platen; said type-bearing element comprising a shell including cylindrical inner portions slidably guided by said support member and a plurality of external radial ribs projecting from said shell and having a section substantially circular so as to define the spherical surface of said type-bearing element, and each of said ribs supporting projecting therefrom the types of one of said corresponding columns.

23. A type-bearing element as in claim 22, herein said selector system further comprises a truing member supported by said base member and means actuating said truing member from a rest to an actuated position upon operation of said striking means over said base member, and the shell of said type-bearing element comprises, in an equatorial zone thereof a series of notches interposed between said columns of types for being engaged by said truing member in the actuated position thereof.

* * * * *